US011738845B2

(12) United States Patent
Miyaki

(10) Patent No.: US 11,738,845 B2
(45) Date of Patent: Aug. 29, 2023

(54) OPERATION DEVICE IN SHIP PROPULSION SYSTEM

(71) Applicant: SUZUKI MOTOR CORPORATION, Hamamatsu (JP)

(72) Inventor: Tomohiko Miyaki, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 212 days.

(21) Appl. No.: 17/465,205

(22) Filed: Sep. 2, 2021

(65) Prior Publication Data

US 2022/0081093 A1 Mar. 17, 2022

(30) Foreign Application Priority Data

Sep. 15, 2020 (JP) ..... 2020-154347

(51) Int. Cl.

| | |
|---|---|
| ***B63H 21/21*** | (2006.01) |
| ***B63B 79/40*** | (2020.01) |
| ***B63B 45/08*** | (2006.01) |
| ***B63H 1/14*** | (2006.01) |
| ***B63H 23/02*** | (2006.01) |
| ***B63H 21/17*** | (2006.01) |

(52) U.S. Cl.

CPC ..... *B63H 21/213* (2013.01); *B63B 45/08* (2013.01); *B63B 79/40* (2020.01); *B63H 1/14* (2013.01); *B63H 21/17* (2013.01); *B63H 23/02* (2013.01)

(58) Field of Classification Search

CPC ..... B63H 21/213; B63H 21/17; B63H 1/14; B63H 23/02; B63B 79/40; B63B 45/08

See application file for complete search history.

(56) References Cited

U.S. PATENT DOCUMENTS

| | | | | |
|---|---|---|---|---|
| 2005/0170708 | A1* | 8/2005 | Okuyama | B63H 21/17 440/1 |
| 2007/0082566 | A1* | 4/2007 | Okuyama | B63H 25/42 440/53 |
| 2010/0250036 | A1 | 9/2010 | Bamba et al. | 701/21 |

FOREIGN PATENT DOCUMENTS

JP 5285490 B2 9/2013

* cited by examiner

*Primary Examiner* — Stephen P Avila

(74) *Attorney, Agent, or Firm* — Stein IP, LLC

(57) ABSTRACT

An operation device in a ship propulsion system including a ship propulsion machine, ship-mounted equipment, and a power supply, the operation device including a single push button switch and an operation processor performing processing. The operation processor detects a pressing mode of the push button switch when the push button switch is pressed while the ship-mounted equipment and the power supply are disconnected and the power source is stopped, performs processing of connecting the ship-mounted equipment and the power supply and starting the power source when the detected pressing mode is a first mode, and performs processing of connecting the ship-mounted equipment and the power supply while maintaining the power source in a stopped state when the detected pressing mode is a second mode.

8 Claims, 5 Drawing Sheets

OPERATION DEVICE IN SHIP PROPULSION SYSTEM

CROSS-REFERENCE TO RELATED APPLICATIONS

The disclosure of Japanese Patent Application No. 2020-154347 filed on Sep. 15, 2020, including specification, drawings and claims is incorporated herein by reference in its entirety.

TECHNICAL FIELD

The present invention relates to an operation device in a ship propulsion system.

BACKGROUND ART

A ship is provided with a ship propulsion system that controls propulsion of the ship. The ship propulsion system is configured by a ship propulsion machine, a propulsion machine control device, ship-mounted equipment, and the like.

The ship propulsion machine is an outboard motor, an inboard/outboard motor, an inboard motor, and the like. The ship propulsion machine is provided at a stern of the ship. Further, the ship propulsion machine includes a power source such as an engine (internal combustion engine) or an electric motor, and a propeller that converts power of the power source into a propulsive force.

The propulsion machine control device is a device that controls the ship propulsion machine. For example, when the power source of the ship propulsion machine is an engine, an engine control module (ECM) that controls the engine is connected to the ship propulsion machine. Further, the ship is provided with a boat control module (BCM) that comprehensively controls the devices provided in the ship propulsion system. For example, in a case of a multi-machine ship in which a plurality of outboard motors are attached to the ship, the BCM controls interlocking of the plurality of outboard motors. Further, a cockpit of the ship is provided with a remote control device (hereinafter referred to as "remote control device") capable of controlling, by operating an operation lever, a rotation speed of the power source of the ship propulsion machine (speed of the ship) and a rotation direction of the propeller (forward/backward movement of the ship). These ECM, BCM and remote control device all correspond to the propulsion machine control device.

Further, in the cockpit of the ship, a gauge device for monitoring the ship propulsion machine by displaying a rotation speed of the power source of the ship propulsion machine, a remaining amount of fuel, and the like on a display is provided. Further, a radio, a wireless device, lights and the like are generally mounted in the ship. Further, a ship-dedicated display for a fish finder, a nautical chart (a chart plotter), and the like are often mounted in the ship. The electrical equipment such as the gauge device, the radio, the wireless device, the lights, and the ship-dedicated display provided in the ship all correspond to the ship-mounted equipment.

The ship-mounted equipment operates by being supplied with electric power from a power supply provided in the ship propulsion machine or the ship. Further, during operation of the ship propulsion machine and the propulsion machine control device, electric power is also supplied to the ship-mounted equipment from the power supply. Further, as the power supply, a battery provided in the ship propulsion machine or the ship is used.

Further, an operation device is provided in the cockpit of the ship. The operation device includes a power switch, a start/stop switch, and the like. The power switch is a switch for switching between connection and disconnection between the ship-mounted equipment and the power supply. The start/stop switch is a switch that starts and stops the power source of the ship propulsion machine.

In an operation device in the related art, a power switch and a start/stop switch are independent of each other. In other words, the operation device in the related art is provided with at least two switches including the power switch and the start/stop switch. The power switch is, for example, a rotary switch. When a knob of the power switch is turned clockwise from a power off position to a power on position while the ship-mounted equipment and the power supply are disconnected, the ship-mounted equipment and the power supply are connected. Further, when the knob of the power switch is turned counterclockwise from the power on position to the power off position while the ship-mounted equipment and the power supply are connected, the ship-mounted equipment and the power supply are disconnected. On the other hand, the start/stop switch is, for example, a momentary push button switch.

In the operation device in the related art, when a user of the ship and the ship propulsion machine starts to use the ship and the ship propulsion machine, first, the knob of the power switch is turned clockwise to the power on position, and the ship-mounted equipment and the power supply are connected. Next, the user presses the start/stop switch to start the power source of the ship propulsion machine. On the other hand, when the use of the ship and the ship propulsion machine is terminated, the user turns the knob of the power switch counterclockwise to the power off position. Accordingly, the power source of the ship propulsion machine is stopped, and the ship-mounted equipment and the power supply are disconnected.

In the operation device in the related art, the user can use the ship-mounted equipment in a power-supply state without starting the power source of the ship propulsion machine by switching the knob of the power switch from the power off position to the power on position to connect the ship-mounted equipment and the power supply. For example, the user can listen to the radio, communicate with the wireless device, or set or adjust the ship-dedicated display in a state where the power source of the ship propulsion machine is stopped.

FIG. 2 of Patent Literature 1 to be described below shows an operation panel provided in a maneuvering seat of the ship. The operation panel is provided with a key switch, an all-machine start/stop switch, and individual start/stop switches, and these switches are independent of one another.

Patent Literature 1: JP-B2-5285490

SUMMARY OF INVENTION

The present invention provides an operation device in a ship propulsion system including a ship propulsion machine provided in a ship, ship-mounted equipment that is electric equipment provided in the ship, and a power supply provided in the ship propulsion machine or the ship, the operation device configured to perform an operation of connecting or disconnecting the ship-mounted equipment and the power supply and an operation of starting or stopping a power source of the ship propulsion machine, the operation device including: a single push button switch; and an operation processor configured to perform processing in response to pressing of the push button switch, wherein the operation processor is configured: to detect a pressing mode of the push button switch when the push button switch is pressed while the ship-mounted equipment and the power supply are disconnected and the power source is stopped, to perform processing of connecting the ship-mounted equipment and the power supply and starting the power source in a case where the detected pressing mode is a first mode, and to perform processing of connecting the ship-mounted equipment and the power supply while maintaining the power source in a stopped state in a case where the detected pressing mode is a second mode, and to perform processing of stopping the power source and disconnecting the ship-mounted equipment and the power supply when the push button switch is pressed while the ship-mounted equipment and the power supply are connected and the power source is in operation.

DESCRIPTION OF EMBODIMENTS

Figure 1:
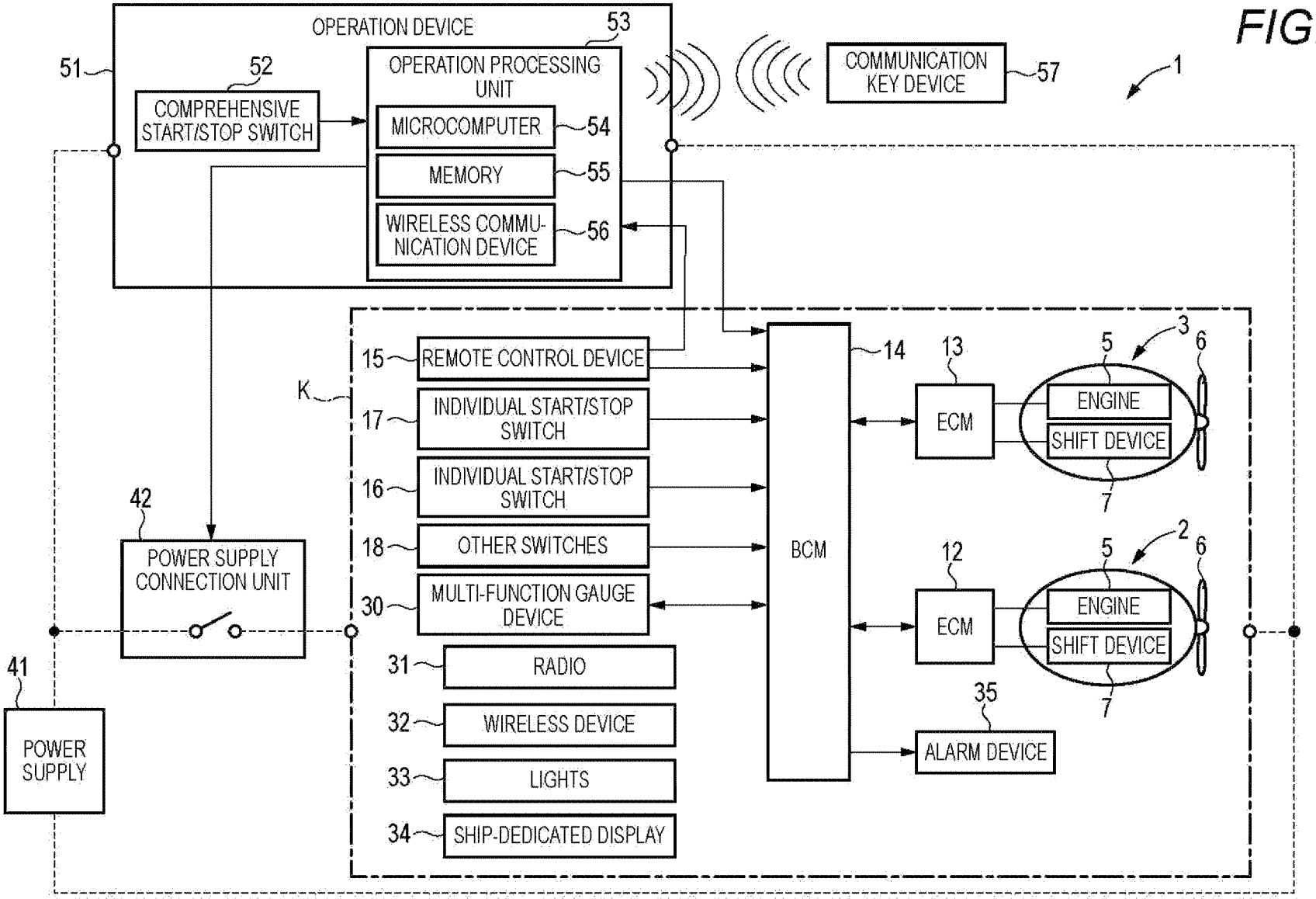
FIG. 1 is an explanatory diagram showing a configuration of a ship propulsion system including an operation device according to a first embodiment of the present invention.

Reducing the number of switches disposed in the cockpit, mistakes in switch selection can be reduced, and an empty space in the cockpit can be increased to facilitate the addition of other components. Further, by reducing the number of switches, the manufacturing cost of the operation device can be reduced. Therefore, it is conceivable to combine the power switch and the start/stop switch in the operation device into one push button switch.

For example, the switch provided in the operation device is only a single momentary push button switch. Then, when the push button switch is pressed once in a state where the ship-mounted equipment and the power source are disconnected and the power source of the ship propulsion machine is stopped, the connection between the ship-mounted equipment and the power supply and the start of the power source of the ship propulsion machine is performed almost at the same time. Further, when the push button switch is pressed once in a state where the ship-mounted equipment and the power source are connected and the power source of the ship propulsion machine is in operation, the disconnection between the ship-mounted equipment and the power supply and the stop of the power source of the ship propulsion machine is performed almost at the same time However, when the power switch and the start/stop switch are combined into one push button switch in this way, the start of the power source of the ship propulsion machine and the connection between the ship-mounted equipment and the power supply are linked. Therefore, the user cannot turn on the ship-mounted equipment without starting the power source of the ship propulsion machine. For example, the user cannot listen to the radio or set the ship-dedicated display in a state where the power source of the ship propulsion machine is stopped. Therefore, convenience of using the ship is reduced due to that the power switch and the start/stop switch are combined into one push button switch.

The present invention has been made in view of, for example, the above-mentioned problems, and an object of the present invention is to provide an operation device capable of preventing decrease in convenience of using a ship while combining a power switch and a start/stop switch into one push button switch.

An operation device according to an embodiment of the present invention is an operation device in a ship propulsion system that controls propulsion of a ship or the like. The ship propulsion system includes a ship propulsion machine provided in the ship, ship-mounted equipment that is electric equipment provided in the ship, and a power supply provided in the ship propulsion machine or the ship. The operation device is a device that performs an operation of connecting or disconnecting the ship-mounted equipment and the power supply and an operation of starting or stopping a power source of the ship propulsion machine.

The ship-mounted equipment is various types of electric equipment provided in the ship. For example, electric equipment such as accessories, attachments, or options of the ship or ship propulsion machine which are mounted in the ship, corresponds to the ship-mounted equipment. Further, electric equipment that is used for sailing, business using a ship, leisure using a ship, and the like and is mounted in the ship corresponds to the ship-mounted equipment. Further, electric equipment that observes, monitors, or diagnoses a state of the ship or ship propulsion machine and is mounted in the ship corresponds to the ship-mounted equipment. For example, a radio, a wireless device, lights, and the like mounted in the ship all correspond to the ship-mounted equipment, and a ship-dedicated display for a fish finder, a chart plotter, or the like mounted in the ship also corresponds to the ship-mounted equipment. Further, a gauge device, a failure diagnosis device, and the like mounted in the ship also correspond to the ship-mounted equipment.

Further, the operation device according to the embodiment of the present invention includes a single push button switch and an operation processor that performs processing in response to pressing of the push button switch. The operation processor detects a pressing mode of the push button switch when the push button switch is pressed while the ship-mounted equipment and the power supply are disconnected and a power source of the ship propulsion machine is stopped, performs processing of connecting the ship-mounted equipment and the power supply and starting the power source of the ship propulsion machine in a case where the detected pressing mode is a first mode, and performs processing of connecting the ship-mounted equipment and the power supply while maintaining the power source of the ship propulsion machine in a stopped state in a case where the detected pressing mode is a second mode. Further, when the push button switch is pressed while the ship-mounted equipment is connected to the power supply and the power source of the ship propulsion machine is in operation, the operation processor performs processing of stopping the power source of the ship propulsion machine and disconnecting the ship-mounted equipment and the power supply.

The single push button switch in the operation device according to the present embodiment functions as a power switch that switches between connection and disconnection between the ship-mounted equipment and the power supply, and also functions as a start/stop switch that starts and stops the power source of the ship propulsion machine, based on the operation of the operation processor. Further, based on the operation of the operation processor, the user can connect the ship-mounted equipment and the power supply without starting the power source of the ship propulsion machine by pressing the push button switch in the second mode while the ship-mounted equipment and the power supply are disconnected and the power source of the ship propulsion machine is stopped. For example, when the ship-mounted equipment is a radio, by pressing the push button switch in the second mode, the user can turn on the radio and listen to the radio in a state where the power source of the ship propulsion machine is stopped. Further, for example, when the ship-mounted equipment is a ship-dedicated display for a fish finder, a chart plotter, or the like, the user can set or adjust the ship-dedicated display in a state where the power source of the ship propulsion machine is stopped by pressing the push button switch in the second mode.

In this way, according to the operation device of the present embodiment, the decrease in convenience of using the ship can be prevented while combining the power switch and the start/stop switch into one push button switch.

First Embodiment

Figure 2:
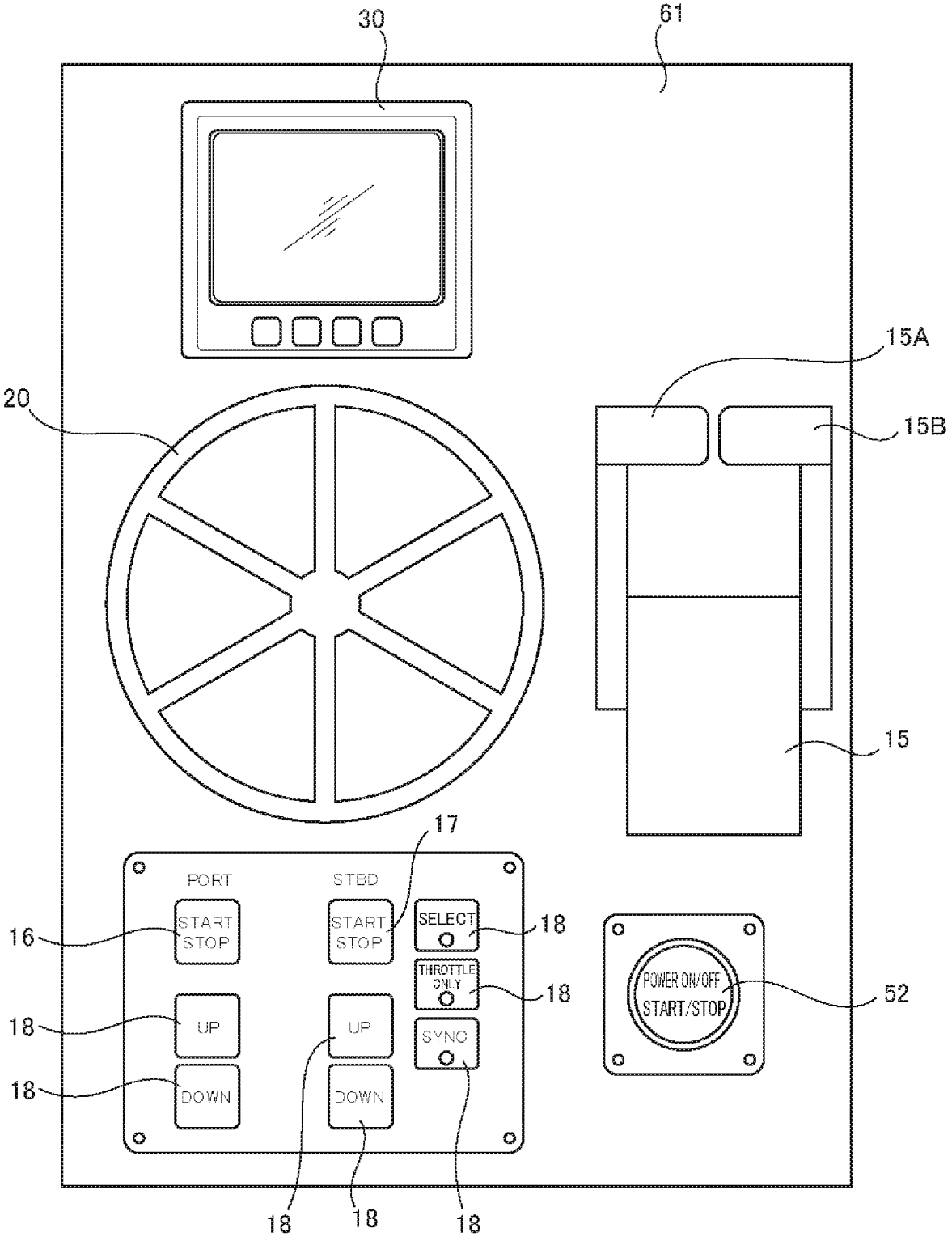
FIG. 2 is an explanatory diagram showing a cockpit of a ship to which the ship propulsion system including the operation device of the first embodiment of the present invention is applied.

FIG. 1 shows a configuration of a ship propulsion system 1 including an operation device 51 according to a first embodiment of the present invention. FIG. 2 is shows a cockpit 61 of a ship to which the ship propulsion system 1 is applied.

The ship propulsion system 1 is a system that controls propulsion of a ship with two outboard motors 2, 3 as ship propulsion machines.

The ship propulsion system 1 includes two outboard motors 2, 3. These outboard motors 2, 3 are attached to left and right portions of a stern of the ship, respectively. Each of these outboard motors 2, 3 includes an engine (internal combustion engine) 5 as a power source, a propeller 6 that generates a propulsive force for the ship, a gear (not shown) that transmits the power of the engine 5 to the propeller 6, a shift device 7 as a power transmission switching device that switches a position of the gear, and the like.

The shift device 7 switches the position of the gear to any of a forward connection position, a backward connection position, and a disconnection position. When the position of the gear is the forward connection position, the power of the engine 5 is transmitted to the propeller 6 such that the propeller 6 rotates in a direction (forward direction) in which the ship moves forward. When the position of the gear is the backward connection position, the power of the engine 5 is transmitted to the propeller 6 such that the propeller 6 rotates in a direction (reverse direction) in which the ship moves backward. When the position of the gear is the disconnection position, the power of the engine 5 is not transmitted to the propeller 6.

Further, each of the outboard motors 2, 3 is provided with, for example, many electrical components such as a starter motor, an electric motor for opening and closing a throttle valve of an electronically controlled throttle, a drive circuit for driving a fuel injection valve, an ignition circuit for generating a voltage applied to an ignition plug, and various sensors.

Further, the ship propulsion system 1 includes ECMs 12, 13 and a BCM 14 as outboard motor control devices for controlling the outboard motors 2, 3.

The ECMs 12, 13 are devices that control the engines 5 and the shift device 7 of the outboard motors 2, 3. The ECMs 12, 13 are respectively provided for the outboard motors 2, 3. The ECM 12 is, for example, attached to an upper portion of the outboard motor 2 on a left side, and is connected to the outboard motor 2. The ECM 13 is, for example, attached to an upper portion of the outboard motor 3 on a right side, and is connected to the outboard motor 3. Further, each of the ECMs 12, 13 includes an electric circuit including a microcomputer and the like.

The BCM 14 is a device that controls the two outboard motors 2, 3 in conjunction with each other, as well as comprehensively controls the devices configuring the ship propulsion system 1. The ECM 14 is provided in the ship. The BCM 14 is connected to and controls the ECMs 12, 13, an alarm device 35, and the like. Further, the BCM 14 includes an electric circuit including a microcomputer and the like.

The ship propulsion system 1 includes, as outboard motor control devices, a remote control device 15, individual start/stop switches 16, 17, and other switches 18. These devices are connected to the BCM 14. As shown in FIG. 2, these devices are provided in the cockpit 61 of the ship.

The remote control device 15 is a device that controls a rotation speed of the engine 5, a rotation direction of the propeller 6, and the like in each of the outboard motors 2, 3. The remote control device 15 includes two operation levers 15A, 15B. The left operation lever 15A is a lever that controls the rotation speed of the engine 5, the rotation direction of the propeller 6, and the like in the left outboard motor 2. The right operation lever 15B is a lever that controls the rotation speed of the engine 5, the rotation direction of the propeller 6, and the like in the right outboard motor 3. When the two operation levers 15A, 15B are tilted forward, the positions of the gears of the outboard motors 2, 3 are switched to the forward connection position by the shift devices 7 of the outboard motors 2, 3. As a result, the propellers 6 of the outboard motors 2, 3 rotate in the forward direction, and the ship moves forward. Further, when a forward tilting amount of each of the two operation levers 15A, 15B is increased, the rotation speed of the engine 5 of each of the outboard motors 2, 3 is increased, and a forward moving speed of the ship is increased. Further, when the two operation levers 15A, 15B are tilted rearward, the positions of the gears of the outboard motors 2, 3 are switched to the backward connection position by the shift devices 7 of the outboard motors 2, 3. As a result, the propeller 6 of each of the outboard motors 2, 3 rotates in the reverse direction, and the ship moves backward. Further, when a rearward tilting amount of each of the two operation levers 15A, 15B is increased, the rotation speed of the engine 5 of each of the outboard motors 2, 3 is increased, and the backward moving speed of the ship is increased. Further, when the two operation levers 15A, 15B are set to a neutral position, the positions of the gears of the outboard motors 2, 3 are switched to the disconnection position by the shift devices 7 of the outboard motors 2, 3. Accordingly, the rotation of the propellers 6 of the outboard motors 2, 3 is stopped, and the ship is stopped.

The individual start/stop switch 16 is a switch for starting and stopping the engine 5 of the left outboard motor 2. The individual start/stop switch 17 is a switch for starting and stopping the engine 5 of the right outboard motor 3. Other switches 18 include, for example, a trim/tilt-up switch for performing a trim/tilt-up operation of each of the outboard motors 2, 3, a trim/tilt-down switch for performing a trim/tilt-down operation of each of the outboard motors 2, 3, and the like.

The ship propulsion system 1 includes a steering wheel 20 and a direction control device as steering devices for steering the ship. As shown in FIG. 2, the steering wheel 20 is provided in the cockpit 61 of the ship. The direction control device is a device that performs control to change left and right directions of each of the outboard motors 2, 3 in response to an operation of the steering wheel 20. The direction control device includes, for example, a hydraulic pump, a hydraulic cylinder, and the like (both not shown), and these are provided in the ship.

Further, as shown in FIG. 1, the ship propulsion system 1 includes a multi-function gauge device 30 as ship-mounted equipment that is electric equipment provided in the ship. The multi-function gauge device 30 includes a display and has a function of displaying the rotation speed of the engine 5 of each of the outboard motors 2, 3, the position of the gear of each of the outboard motors 2, 3, the speed of the ship, a remaining amount of fuel, and the like on the display. Further, the multi-function gauge device 30 also has a function of checking an operation or diagnosing a failure of each of the outboard motors 2, 3, the ECMs 12, 13, and the like, such as checking a sensor value of a sensor in each of the outboard motors 2, 3 and a voltage of each part. The multi-function gauge device 30 is connected to the BCM 14. As shown in FIG. 2, the multi-function gauge device 30 is provided in the cockpit 61 of the ship.

As shown in FIG. 1, the ship propulsion system 1 includes, as the ship-mounted equipment, a radio 31, a wireless device 32, lights 33, and a ship-dedicated display 34. The radio 31, the wireless device 32, the lights 33, and the ship-dedicated display 34 are provided in the ship. The ship-dedicated display 34 is a display for a fish finder, a chart plotter, or the like.

Further, the ship propulsion system 1 includes the alarm device 35. The alarm device 35 is a device that outputs an alarm sound (for example, a buzzer sound) for issuing an alarm or the like, and is provided in the ship. For example, the alarm device 35 is connected to the BCM 14 and is controlled by the BCM 14. The alarm device 35 corresponds to the ship-mounted equipment.

Hereinafter, the ECMs 12, 13, the BCM 14, the remote control device 15, the individual start/stop switches 16, 17, and other switches 18 are collectively referred to as outboard motor control devices 12 to 18. The multi-function gauge device 30, the radio 31, the wireless device 32, the lights 33, the ship-dedicated display 34, and the alarm device 35 are collectively referred to as ship-mounted equipment 30 to 35.

Further, the ship propulsion system 1 includes a power supply 41, a power supply connection unit 42, and the operation device 51.

The power supply 41 is a device that supplies electric power to the outboard motors 2, 3 (specifically, the electrical components provided in the outboard motors 2, 3), the outboard motor control devices 12 to 18, the ship-mounted equipment 30 to 35, and the operation device 51. As the power supply 41, a battery provided in the outboard motors 2, 3 or the ship is used.

The power supply connection unit 42 is a device or a circuit that switches, under control of the operation device 51, connection and disconnection between the power supply 41 and each of the outboard motors 2, 3, the outboard motor control devices 12 to 18, and the ship-mounted equipment 30 to 35. For example, a relay or the like is used as the power supply connection unit 42. The power supply connection unit 42 is provided in, for example, the ship. In FIG. 1, a device and equipment surrounded by a two-dot chain line K are connected to the power supply 41 via the power supply connection unit 42.

The operation device 51 is a device that performs an operation of connecting or disconnecting the power supply 41 and each of the outboard motors 2, 3, the outboard motor control devices 12 to 18 and the ship-mounted equipment 30 to 35, and an operation of starting or stopping the engine 5 of each of the outboard motors 2, 3. The operation device 51 is constantly connected to the power supply 41 without using the power supply connection unit 42.

The operation device 51 includes a comprehensive start/stop switch 52 and an operation processing unit 53 as an operation processor.

As shown in FIG. 2, the comprehensive start/stop switch 52 is provided in the cockpit 61 of the ship. The comprehensive start/stop switch 52 is a single momentary push button switch. The comprehensive start/stop switch 52 has an all-device start/stop function and a power on/off function. The all-device start/stop function is a function of starting a plurality of outboard motors (a plurality of outboard motors attached to the ship) provided in the ship propulsion system 1, that is, in the present embodiment, the engines 5 of the two outboard motors 2, 3 substantially at the same time or stopping the engines 5 of the two outboard motors 2, 3 substantially at the same time. The "starting . . . substantially at the same time" includes meaning of starting . . . at the same time and meaning of starting . . . continuously and sequentially at short intervals, and the "stopping . . . substantially at the same time" includes meaning of stopping . . . at the same time and meaning of stopping . . . continuously and sequentially at short intervals. The power on/off function is a function of controlling the power supply connection unit 42 to switch connection and disconnection between the power supply 41 and each of the outboard motors 2, 3, the outboard motor control devices 12 to 18, and the ship-mounted equipment 30 to 35.

The operation processing unit 53 is a device that performs processing (hereinafter referred to as "operation processing") for realizing the all-device start/stop function and the power on/off function of the comprehensive start/stop switch 52. The operation processing unit 53 is provided, for example, in the cockpit 61 of the ship and in the vicinity of the comprehensive start/stop switch 52. Further, the operation processing unit 53 includes a microcomputer 54, a memory 55, and a wireless communication device 56. As shown in FIG. 1, the comprehensive start/stop switch 52 is connected to the operation processing unit 53, and a pressing signal indicating that the comprehensive start/stop switch 52 is pressed is output from the comprehensive start/stop switch 52 to the operation processing unit 53. The operation processing unit 53 is connected to the power supply connection unit 42, and a power supply connection signal and a power supply disconnection signal, which are to be described later, are output from the operation processing unit 53 to the power supply connection unit 42. The operation processing unit 53 is connected to the BCM 14, and an all-device start signal and an all-device stop signal, which are to be described later, are output from the operation processing unit 53 to the BCM 14. The operation processing unit 53 is connected to the remote control device 15, and a lever position signal to be described later is output from the remote control device 15 to the operation processing unit 53.

Further, the ship propulsion system 1 of the present embodiment has a keyless start function. The keyless start function is a function of starting the engine of the outboard motor only by performing a switch operation without inserting a key into a cylinder and turning the key. The operation processing unit 53 also performs processing of realizing the keyless start function.

Here, the keyless start function of the ship propulsion system 1 will be specifically described. The keyless start function is realized by the operation device 51 and a communication key device 57. The communication key device 57 is a small device that can be carried by a user, and has a built-in wireless communication device 56 and a memory 55. The operation processing unit 53 of the operation device 51 includes the wireless communication device 56 and the memory 55 as described above. The same private code is stored in the memory of the communication key device 57 and the memory 55 of the operation processing unit 53. When the user presses the comprehensive start/stop switch 52, the operation processing unit 53 establishes communication with the communication key device 57. Immediately thereafter, the communication key device 57 transmits the private code stored in the memory of the communication key device 57 to the operation processing unit 53. The operation processing unit 53 collates the private code transmitted from the communication key device 57 with the private code stored in the memory 55 of the operation processing unit 53, permits start of the engines 5 of the outboard motors 2, 3 when the two private codes match each other, and prohibits the start of the engines 5 of the outboard motors 2, 3 when the two private codes do not match each other.

Figure 3:
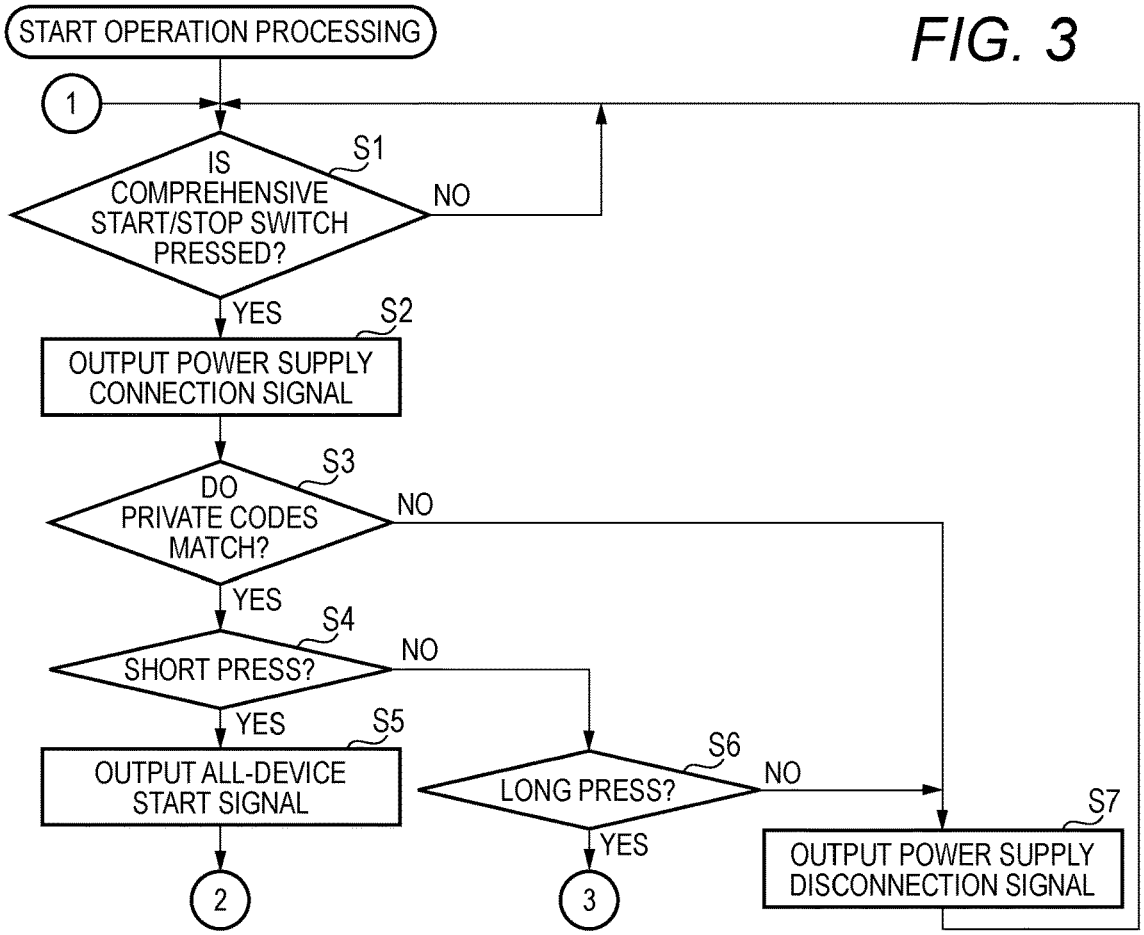
FIG. 3 is a flowchart showing a part of operation processing in the operation device according to the first embodiment of the present invention.
Figure 4:
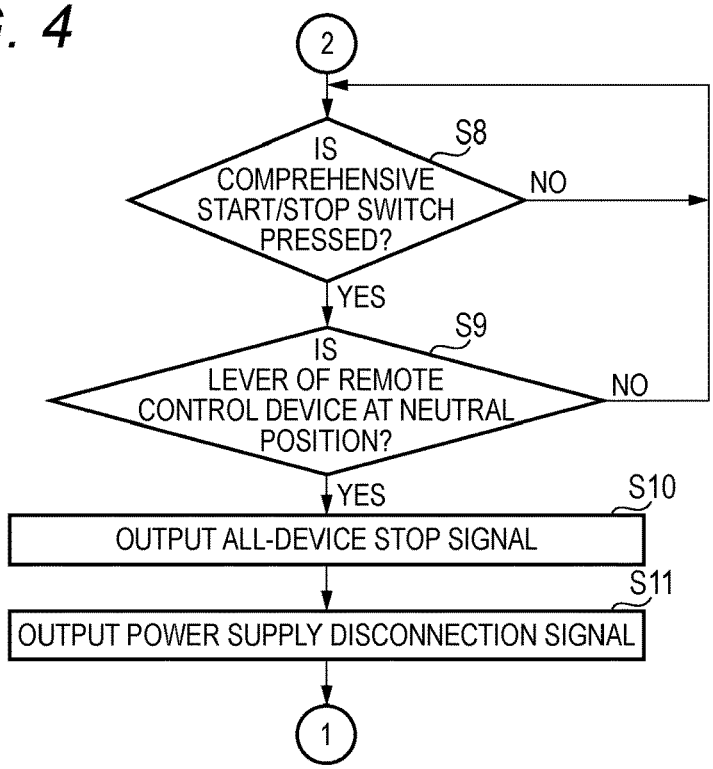
FIG. 4 is a flowchart showing a part of the operation processing following FIG. 3.
Figure 5:
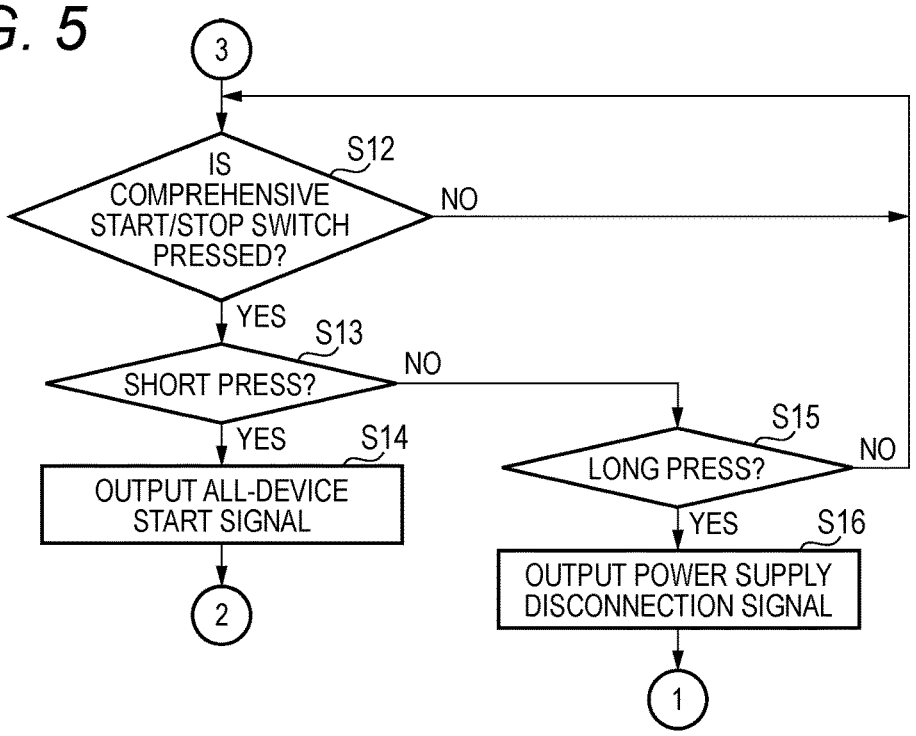
FIG. 5 is a flowchart showing a part of the operation processing following FIG. 3.

FIGS. 3 to 5 show the operation processing performed by the operation processing unit 53. In the operation processing, steps S1 to S7 in FIG. 3 show processing in a state where each of the outboard motors 2, 3, the outboard motor control devices 12 to 18, and the ship-mounted equipment 30 to 35 is disconnected from the power supply 41, and the engine 5 of each of the outboard motors 2, 3 is stopped.

In FIG. 3, the operation processing unit 53 monitors whether the comprehensive start/stop switch 52 is pressed while each of the outboard motors 2, 3, the outboard motor control devices 12 to 18, and the ship-mounted equipment 30 to 35 is disconnected from the power supply 41, and the engine 5 of each of the outboard motors 2, 3 is stopped (step S1). During this time, in order to prevent battery exhaustion, the operation processing unit 53 may monitor whether the comprehensive start/stop switch 52 is pressed in a state where the operation processing unit 53 is shifted to a power saving operation.

When the user presses the comprehensive start/stop switch 52, a pressing signal is output from the comprehensive start/stop switch 52 to the operation processing unit 53. When the pressing signal is output to the operation processing unit 53 (step S1: YES), in response to the output, the operation processing unit 53 outputs, to the power supply connection unit 42, a power supply connection signal for connecting each of the outboard motors 2, 3, the outboard motor control devices 12 to 18, and the ship-mounted equipment 30 to 35 to the power supply 41 (step S2). Accordingly, each of the outboard motors 2, 3, the outboard motor control devices 12 to 18, and the ship-mounted equipment 30 to 35 is connected to the power supply 41 by the power supply connection unit 42, and electric power is supplied from the power supply 41 to each of the outboard motors 2, 3, the outboard motor control devices 12 to 18, and the ship-mounted equipment 30 to 35.

Subsequently, the operation processing unit 53 establishes communication with the communication key device 57 carried by the user, and immediately thereafter, the operation processing unit 53 receives a private code transmitted from the communication key device 57. Then, it is determined whether the private code transmitted from the communication key device 57 matches the private code stored in the memory 55 of the operation processing unit 53 (step S3).

When the private code transmitted from the communication key device 57 matches the private code stored in the memory 55 of the operation processing unit 53 (step S3: YES), the operation processing unit 53 detects a pressing mode of the comprehensive start/stop switch 52 and determines whether the pressing mode of the comprehensive start/stop switch 52 is a first mode (step S4). In the present embodiment, the first mode is a short press. That is, in step S4, the operation processing unit 53 determines whether the pressing mode of the comprehensive start/stop switch 52 is a short press. Specifically, while the user is pressing the comprehensive start/stop switch 52, the output of the pressing signal from the comprehensive start/stop switch 52 is continued. In step S4, based on the pressing signal, the operation processing unit 53 detects a duration of the state where the comprehensive start/stop switch 52 is pressed, and determines whether the duration of the state where the comprehensive start/stop switch 52 is pressed is less than a first reference time. A case where the duration of the state where the comprehensive start/stop switch 52 is pressed is less than the first reference time means that the pressing mode of the comprehensive start/stop switch 52 is a short press. The first reference time is preferably a time by which a short press and a long press of the comprehensive start/stop switch 52 can be clearly distinguished from each other, and is, for example, about 0.2 second to 0.3 second.

When the pressing mode of the comprehensive start/stop switch 52 is a short press (step S4: YES), the operation processing unit 53 outputs, to the BCM 14, an all-device start signal for starting the engines 5 of the two outboard motors 2, 3 substantially at the same time (step S5). The BCM 14 controls the ECMs 12, 13 in response to the all-device start signal to start the engines 5 of the two outboard motors 2, 3 substantially at the same time. Thereafter, the operation processing unit 53 shifts the processing to step S8 in FIG. 4.

On the other hand, when the pressing mode of the comprehensive start/stop switch 52 is not a short press (step S4: NO), the operation processing unit 53 determines whether the pressing mode of the comprehensive start/stop switch 52 is a second mode (step S6). In the present embodiment, the second mode is a long press. That is, in step S6, the operation processing unit 53 determines whether the pressing mode of the comprehensive start/stop switch 52 is a long press. Specifically, in step S6, the operation processing unit 53 determines, based on the pressing signal output from the comprehensive start/stop switch 52, whether the duration of the state where the comprehensive start/stop switch 52 is pressed is equal to or longer than a second reference time longer than the first reference time. A case where the duration of the state where the comprehensive start/stop switch 52 is pressed is equal to or longer than the second reference time means that the pressing mode of the comprehensive start/stop switch 52 is a long press. The second reference time is preferably a time by which a short press and a long press of the comprehensive start/stop switch 52 can be clearly distinguished from each other, and is, for example, about 2 seconds.

Further, the second reference time may be set to a value substantially equal to a duration of output of an alarm sound in operation confirmation processing of the alarm device 35. That is, in many ships, when the power supply of the ship is turned on, the alarm sound is continuously output from the alarm device for a preset time in order to confirm the operation of the alarm device provided in the ship. In the ship according to the present embodiment, when the comprehensive start/stop switch 52 is pressed in a state where each of the outboard motors 2, 3, the outboard motor control devices 12 to 18 and the ship-mounted equipment 30 to 35 is disconnected from the power supply 41 and the engine 5 of each of the outboard motors 2, 3 is stopped, an alarm sound is continuously output from the alarm device 35 for a preset time (for example, about 2 seconds). The second reference time may be set to a value substantially equal to the duration of the alarm sound (a value equal to the duration of the alarm sound, or a value substantially equal to the duration of the alarm sound in consideration of a variation in the duration of the alarm sound). Thus, by continuously pressing the comprehensive start/stop switch 52 from the start of the alarm sound to the end of the alarm sound, this means that the comprehensive start/stop switch 52 is long-pressed. Therefore, the user can easily long-press the comprehensive start/stop switch 52 based on the alarm sound.

When the pressing mode of the comprehensive start/stop switch 52 is a long press (step S6: YES), the operation processing unit 53 shifts the processing to step S12 in FIG. 5 without outputting the all-device start signal to the BCM 14. Thus, until the user presses the comprehensive start/stop switch 52 again, a state is maintained in which each of the outboard motors 2, 3, the outboard motor control devices 12 to 18, and the ship-mounted equipment 30 to 35 is connected to the power supply 41, and the engine 5 of each of the outboard motors 2, 3 is stopped.

On the other hand, when the pressing mode of the comprehensive start/stop switch 52 is neither a short press nor a long press (step S6: NO), the operation processing unit 53 outputs, to the power supply connection unit 42, a power supply disconnection signal for disconnecting each of the outboard motors 2, 3, the outboard motor control devices 12 to 18, and the ship-mounted equipment 30 to 35 from the power supply 41 (step S7). Accordingly, each of the outboard motors 2, 3, the outboard motor control devices 12 to 18, and the ship-mounted equipment 30 to 35 is disconnected from the power supply 41 by the power supply connection unit 42, and the electric power is not supplied from the power supply 41 to each of the outboard motors 2, 3, the outboard motor control devices 12 to 18, and the ship-mounted equipment 30 to 35. Thereafter, the operation processing unit 53 returns the processing to step S1.

Further, when the private code transmitted from the communication key device 57 does not match the private code stored in the memory 55 of the operation processing unit 53 (step S3: NO), the operation processing unit 53 also outputs a power supply disconnection signal to the power supply connection unit 42 to disconnect each of the outboard motors 2, 3, the outboard motor control devices 12 to 18, and the ship-mounted equipment 30 to 35 from the power supply 41 (step S7). Thereafter, the operation processing unit 53 returns the processing to step S1.

In this way, when the user short-presses the comprehensive start/stop switch 52 in a state where each of the outboard motors 2, 3, the outboard motor control devices 12 to 18, and the ship-mounted equipment 30 to 35 is disconnected from the power supply 41, and the engine 5 of each of the outboard motors 2, 3 is stopped, the operation processing unit 53 connects each of the outboard motors 2, 3, the outboard motor control devices 12 to 18, and the ship-mounted equipment 30 to 35 to the power supply 41, and starts the engines 5 of the two outboard motors 2, 3 substantially at the same time. On the other hand, when the user long-presses the comprehensive start/stop switch 52 in a state where each of the outboard motors 2, 3, the outboard motor control devices 12 to 18, and the ship-mounted equipment 30 to 35 is disconnected from the power supply 41 and the engine 5 of each of the outboard motors 2, 3 is stopped, the operation processing unit 53 connects each of the outboard motors 2, 3, the outboard motor control devices 12 to 18, and the ship-mounted equipment 30 to 35 to the power supply 41 while maintaining he engine 5 of each of the outboard motors 2, 3 in a stopped state.

In the operation processing, steps S8 to S11 in FIG. 4 show processing in a state where each of the outboard motors 2, 3, the outboard motor control devices 12 to 18, and the ship-mounted equipment 30 to 35 is connected to the power supply 41, and the engine 5 of each of the outboard motors 2, 3 is in operation.

In FIG. 4, the operation processing unit 53 monitors whether the comprehensive start/stop switch 52 is pressed while each of the outboard motors 2, 3, the outboard motor control devices 12 to 18, and the ship-mounted equipment 30 to 35 is connected to the power supply 41 and the engine 5 of each of the outboard motors 2, 3 is in operation (step S8).

When the user presses the comprehensive start/stop switch 52 and a pressing signal is output from the comprehensive start/stop switch 52 to the operation processing unit 53 (step S8: YES), the operation processing unit 53 subsequently determines whether positions of the operation levers 15A, 15B of the remote control device 15 are both neutral positions (step S9). That is, while each of the outboard motors 2, 3, the outboard motor control devices 12 to 18, and the ship-mounted equipment 30 to 35 is connected to the power supply 41, a lever position signal indicating the positions of the operation levers 15A, 15B of the remote control device 15 is output from the remote control device 15 to the operation processing unit 53. Based on the lever position signal, the operation processing unit 53 determines whether the positions of the operation levers 15A, 15B of the remote control device 15 are both neutral positions.

When the positions of the operation levers 15A, 15B of the remote control device 15 are both the neutral positions (step S9: YES), the operation processing unit 53 outputs, to the BCM 14, an all-device stop signal for stopping the engines 5 of the two outboard motors 2, 3 substantially at the same time (step S10). The BCM 14 controls the ECMs 12, 13 in response to the all-device stop signal to stop the engines 5 of the two outboard motors 2, 3 substantially at the same time.

Subsequently, the operation processing unit 53 outputs a power supply disconnection signal to the power supply connection unit 42 (step S11). Accordingly, each of the outboard motors 2, 3, the outboard motor control devices 12 to 18, and the ship-mounted equipment 30 to 35 is disconnected from the power supply 41 by the power supply connection unit 42. Thereafter, the operation processing unit 53 returns the processing to step S1 in FIG. 3.

On the other hand, when the position of the operation lever 15A or the position of the operation lever 15B of the remote control device 15 is not the neutral position (step S9: NO), the operation processing unit 53 returns the processing to step S8. In this case, the engine 5 of each of the outboard motors 2, 3 is not stopped, and each of the outboard motors 2, 3, the outboard motor control devices 12 to 18, and the ship-mounted equipment 30 to 35 is not disconnected from the power supply 41.

In this way, when the user presses the comprehensive start/stop switch 52 in a state where each of the outboard motors 2, 3, the outboard motor control devices 12 to 18, and the ship-mounted equipment 30 to 35 is connected to the power supply 41 and the engine 5 of each of the outboard motors 2, 3 is in operation, the operation processing unit 53 stops the engines 5 of the two outboard motors 2, 3 substantially at the same time and disconnects each of the outboard motors 2, 3, the outboard motor control devices 12 to 18, and the ship-mounted equipment 30 to 35 from the power supply 41 without detecting or determining the pressing mode of the comprehensive start/stop switch 52.

Further, in the operation processing, steps S12 to S16 in FIG. 5 show processing in a state where each of the outboard motors 2, 3, the outboard motor control devices 12 to 18, and the ship-mounted equipment 30 to 35 is connected to the power supply 41, and the engine 5 of each of the outboard motors 2, 3 is stopped.

In FIG. 5, the operation processing unit 53 monitors whether the comprehensive start/stop switch 52 is pressed while each of the outboard motors 2, 3, the outboard motor control devices 12 to 18, and the ship-mounted equipment 30 to 35 is connected to the power supply 41 and the engine 5 of each of the outboard motors 2, 3 is stopped (step S12).

When the user presses the comprehensive start/stop switch 52 and a pressing signal is output from the comprehensive start/stop switch 52 to the operation processing unit 53 (step S12: YES), the operation processing unit 53 detects the pressing mode of the comprehensive start/stop switch 52 and determines whether the pressing mode of the comprehensive start/stop switch 52 is a short press (step S13). The method of determining whether the short press is performed is the same as the method described in step S4.

When the pressing mode of the comprehensive start/stop switch 52 is a short press (step S13: YES), the operation processing unit 53 outputs an all-device start signal to the BCM 14 (step S14). In response to the all-device start signal, the BCM 14 controls the ECMs 12, 13 to start the engines 5 of the two outboard motors 2, 3 substantially at the same time. Thereafter, the operation processing unit 53 shifts the processing to step S8 in FIG. 4.

On the other hand, when the pressing mode of the comprehensive start/stop switch 52 is not a short press (step S13: NO), the operation processing unit 53 determines whether the pressing mode of the comprehensive start/stop switch 52 is a long press (step S15). The method of determining whether a long press is performed is the same as the method described in step S6.

When the pressing mode of the comprehensive start/stop switch 52 is a long press (step S15: YES), the operation processing unit 53 outputs a power supply disconnection signal to the power supply connection unit 42 (step S16). Thus, each of the outboard motors 2, 3, the outboard motor control devices 12 to 18, and the ship-mounted equipment 30 to 35 is disconnected from the power supply 41. Thereafter, the operation processing unit 53 returns the processing to step S1 in FIG. 3.

On the other hand, when the pressing mode of the comprehensive start/stop switch 52 is neither a short press nor a long press (step S15: NO), the operation processing unit 53 returns the processing to step S12. Thus, until the user presses the comprehensive start/stop switch 52 again, the state is maintained in which each of the outboard motors 2, 3, the outboard motor control devices 12 to 18, and the ship-mounted equipment 30 to 35 is connected to the power supply 41, and the engines 5 of the two outboard motors 2, 3 are stopped.

In this way, when the user short-presses the comprehensive start/stop switch 52 in a state where each of the outboard motors 2, 3, the outboard motor control devices 12 to 18, and the ship-mounted equipment 30 to 35 is connected to the power supply 41 and the engine 5 of each of the outboard motors 2, 3 is stopped, the operation processing unit 53 starts the engines 5 of the two outboard motors 2, 3 substantially at the same time while maintaining a state where each of the outboard motors 2, 3, the outboard motor control devices 12 to 18, and the ship-mounted equipment 30 to 35 is connected to the power supply 41. On the other hand, when the user long-presses the comprehensive start/stop switch 52 in a state where each of the outboard motors 2, 3, the outboard motor control devices 12 to 18, and the ship-mounted equipment 30 to 35 is connected to the power supply 41 and the engine 5 of each of the outboard motors 2, 3 is stopped, the operation processing unit 53 disconnects each of the outboard motors 2, 3, the outboard motor control devices 12 to 18, and the ship-mounted equipment 30 to 35 from the power supply 41.

As described above, in the operation device 51 of the first embodiment of the present invention, the comprehensive start/stop switch 52, which is a single push button switch, has the all-device start/stop function of starting the engines 5 of the two outboard motors 2, 3 substantially at the same time or stopping the engines 5 of the two outboard motors 2, 3 substantially at the same time, and the power on/off function of switching between connection and disconnection between the power supply 41 and each of the outboard motors 2, 3, the outboard motor control devices 12 to 18, and the ship-mounted equipment 30 to 35. Thus, according to the operation device 51 of the present embodiment, the start/stop switch and the power switch, which are independent of each other in the operation device in the related art, can be combined into one push button switch. Therefore, the number of switches disposed in the cockpit 61 can be reduced to reduce mistakes in switch selection, and further, an empty space in the cockpit 61 can be increased to facilitate addition of other components. Further, by reducing the number of switches, the manufacturing cost of the operation device 51 can be lowered.

Further, when the comprehensive start/stop switch 52 is pressed while each of the outboard motors 2, 3, the outboard motor control devices 12 to 18, and the ship-mounted equipment 30 to 35 is disconnected from the power supply 41, and the engine 5 of each of the outboard motors 2, 3 is stopped, the operation device 51 of the first embodiment of the present invention starts the engines 5 of the two outboard motors 2, 3 in a case where the pressing mode of the comprehensive start/stop switch 52 is a short press, and connects each of the outboard motors 2, 3, the outboard motor control devices 12 to 18, and the ship-mounted equipment 30 to 35 to the power supply 41 without starting the engines 5 of the two outboard motors 2, 3, in a case where the pressing mode of the comprehensive start/stop switch 52 is a long press. Thus, the user can select whether to start the engines 5 of the two outboard motors 2, 3 collectively or to turn on the power supply of the ship-mounted equipment 30 to 35 and the like without starting the engines 5 of the outboard motors 2, 3, depending on whether to short-press or long-press the comprehensive start/stop switch 52. Therefore, by long-pressing the comprehensive start/stop switch 52, the user can turn on the ship-mounted equipment 30 to 35 to operate the ship-mounted equipment 30 to 35 in a state where the engines 5 of the outboard motors 2, 3 are stopped. Specifically, in a state where the engine 5 of each of the outboard motors 2, 3 is stopped, the user can listen to the radio by using the radio 31, can perform wireless communication by operating the wireless device 32, and can turn on the lights 33. Further, in a state where the engine 5 of each of the outboard motors 2, 3 is stopped, the user can set and adjusts the ship-dedicated display 34, can set the multi-function gauge device 30, and can perform maintenance work such as operation confirmation of each part of the outboard motors 2, 3 using the multi-function gauge device 30. As described above, according to the operation device 51 of the present embodiment, by the start/stop switch and the power switch are combined into one push button switch, and thus the decrease in convenience of using the ship can be prevented as compared with the operation device in the related art.

Further, according to the operation device 51 of the present embodiment, the user can quickly and collectively turn on the power supply of the outboard motors 2, 3, the outboard motor control devices 12 to 18, and the ship-mounted equipment 30 to 35 and start the engines 5 of the two outboard motors 2, 3 by simply pushing the comprehensive start/stop switch 52 once.

Further, when the comprehensive start/stop switch 52 is pressed while each of the outboard motors 2, 3, the outboard motor control devices 12 to 18, and the ship-mounted equipment 30 to 35 is connected to the power supply 41, and the engine 5 of each of the outboard motors 2, 3 is in operation, the operation device 51 according to the first embodiment of the present invention stops the engines 5 of the outboard motors 2, 3 and disconnects each of the outboard motors 2, 3, the outboard motor control devices 12 to 18, and the ship-mounted equipment 30 to 35 from the power supply 41. Thus, the user can quickly and collectively stop the engines 5 of the two outboard motors 2, 3 and cut off the power supply of the outboard motors 2, 3, the outboard motor control devices 12 to 18, and the ship-mounted equipment 30 to 35 by simply pushing the comprehensive start/stop switch 52 once.

Further, when the comprehensive start/stop switch 52 is pressed while each of the outboard motors 2, 3, the outboard motor control devices 12 to 18, and the ship-mounted equipment 30 to 35 is connected to the power supply 41 and the engine 5 of each of the outboard motors 2, 3 is stopped, the operation device 51 of the first embodiment of the present invention starts the engines 5 of the two outboard motors 2, 3 in a case where the pressing mode of the comprehensive start/stop switch 52 is a short press, and cut off the power supply of the outboard motors 2, 3, the outboard motor control devices 12 to 18 and the ship-mounted equipment 30 to 35 in a case where the pressing mode of the comprehensive start/stop switch 52 is a long press. Therefore, the user can easily select whether to start the engines 5 of the two outboard motors 2, 3 or to cut off the power supply of the ship-mounted equipment 30 to 35 or the like, depending on whether to short-press or long-press the comprehensive start/stop switch 52.

Further, when performing the processing of stopping the engines 5 of the outboard motors 2, 3, the operation device according to the first embodiment of the present invention does not stop the engines 5 of the outboard motors 2, 3 when the position of the operation lever 15A or the position of the operation lever 15B of the remote control device 15 is not the neutral position, that is, when the position of any one of the gears of the outboard motors 2, 3 is the forward connection position or the backward connection position (see FIG. 4). Therefore, the processing can be performed according to the intention of the user.

Second Embodiment

Figure 6:
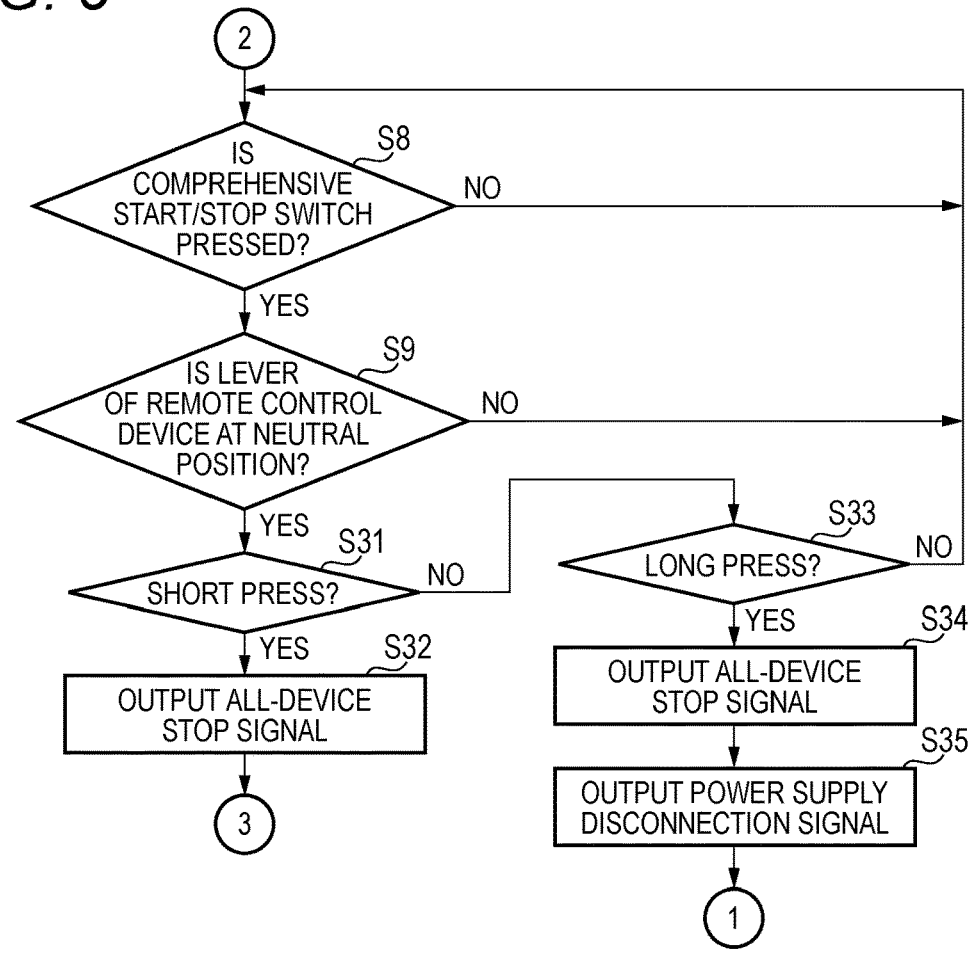
FIG. 6 is a flowchart showing a part of operation processing in an operation device according to a second embodiment of the present invention.

FIG. 6 shows a part of operation processing in the operation device 51 according to a second embodiment of the present invention. As can be seen from a comparison between FIG. 6 and FIG. 4, the second embodiment of the present invention is a modification of the processing in a state where each of the outboard motors 2, 3, the outboard motor control devices 12 to 18, and the ship-mounted equipment 30 to 35 is connected to the power supply 41, and the engine 5 of each of the outboard motors 2, 3 is in operation, in the operation processing of the first embodiment of the present invention. In FIG. 6, the same steps as those shown in FIG. 4 are denoted by the same reference numerals.

In the first embodiment described above, as shown in FIG. 4, the comprehensive start/stop switch 52 is pressed while each of the outboard motors 2, 3, the outboard motor control devices 12 to 18, and the ship-mounted equipment 30 to 35 is connected to the power supply 41, and the engine 5 of each of the outboard motors 2, 3 is in operation, and at that time, when the positions of the operation levers 15A, 15B of the remote control device 15 are both the neutral position, the operation processing unit 53 of the operation device 51 outputs the all-device stop signal to the BCM 14 to stop the engines 5 of the two outboard motors 2, 3 substantially at the same time, and subsequently outputs the power supply disconnection signal to the power supply connection unit 42 to disconnect each of the outboard motors 2, 3, the outboard motor control devices 12 to 18, and the ship-mounted equipment 30 to 35 from the power supply 41.

In contrast, in the second embodiment, as shown in FIG. 6, the comprehensive start/stop switch 52 is pressed while each of the outboard motors 2, 3, the outboard motor control devices 12 to 18, the ship-mounted equipment 30 to 35 is connected to the power supply 41, and the engine 5 of each of the outboard motors 2, 3 is in operation, and at that time, when the positions of the operation levers 15A, 15B of the remote control device 15 are both the neutral position, the operation processing unit 53 determines whether the pressing mode of the comprehensive start/stop switch 52 is a short press, and when the pressing mode of the comprehensive start/stop switch 52 is a short press (step S31: YES), the operation processing unit 53 outputs an all-device stop signal to the BCM 14 to stop the engines 5 of the two outboard motors 2, 3 substantially at the same time (step S32). However, at this time, the operation processing unit 53 does not output a power supply disconnection signal to the power supply connection unit 42. As a result, although the engine 5 of each of the outboard motors 2, 3 is stopped, each of the outboard motors 2, 3, the outboard motor control devices 12 to 18, and the ship-mounted equipment 30 to 35 is connected to the power supply 41.

When the pressing mode of the comprehensive start/stop switch 52 is not a short press (step S31: NO), the operation processing unit 53 determines whether the pressing mode of the comprehensive start/stop switch 52 is a long press, and when the pressing mode of the comprehensive start/stop switch 52 is a long press (step S33: YES), the operation processing unit 53 outputs an all-device stop signal to the BCM 14 to stop the engines 5 of the two outboard motors 2, 3 substantially at the same time (step S34), and subsequently outputs a power supply disconnection signal to the power supply connection unit 42 to disconnect each of the outboard motors 2, 3, the outboard motor control devices 12 to 18, and the ship-mounted equipment 30 to 35 from the power supply 41 (step S35).

On the other hand, when the pressing mode of the comprehensive start/stop switch 52 is neither a short press nor a long press (step S33: NO), the operation processing unit 53 returns the processing to step S8 without outputting both the all-device stop signal and the power supply disconnection signal. Thus, until the comprehensive start/stop switch 52 is pressed again, the state is maintained in which each of the outboard motors 2, 3, the outboard motor control devices 12 to 18, and the ship-mounted equipment 30 to 35 is connected to the power supply 41, and the engine 5 of each of the outboard motors 2, 3 is in operation.

According to the operation device 51 of the second embodiment of the present invention, the user can stop the engine 5 of each of the outboard motors 2, 3 while maintaining the state where the ship-mounted equipment 30 to 35 and the like are connected to the power supply 41 by short-pressing the comprehensive start/stop switch 52 during operation of the engine 5 of each of the outboard motors 2, 3. Thus, the user can stop the engine 5 of each of the outboard motors 2, 3 and immediately operate the ship-mounted equipment 30 to 35. As described above, according to the present embodiment, the start/stop switch and the power switch are combined into one push button switch, and thus the decrease in convenience of using the ship can be prevented as compared with the operation device in the related art.

Third Embodiment

Figure 7:
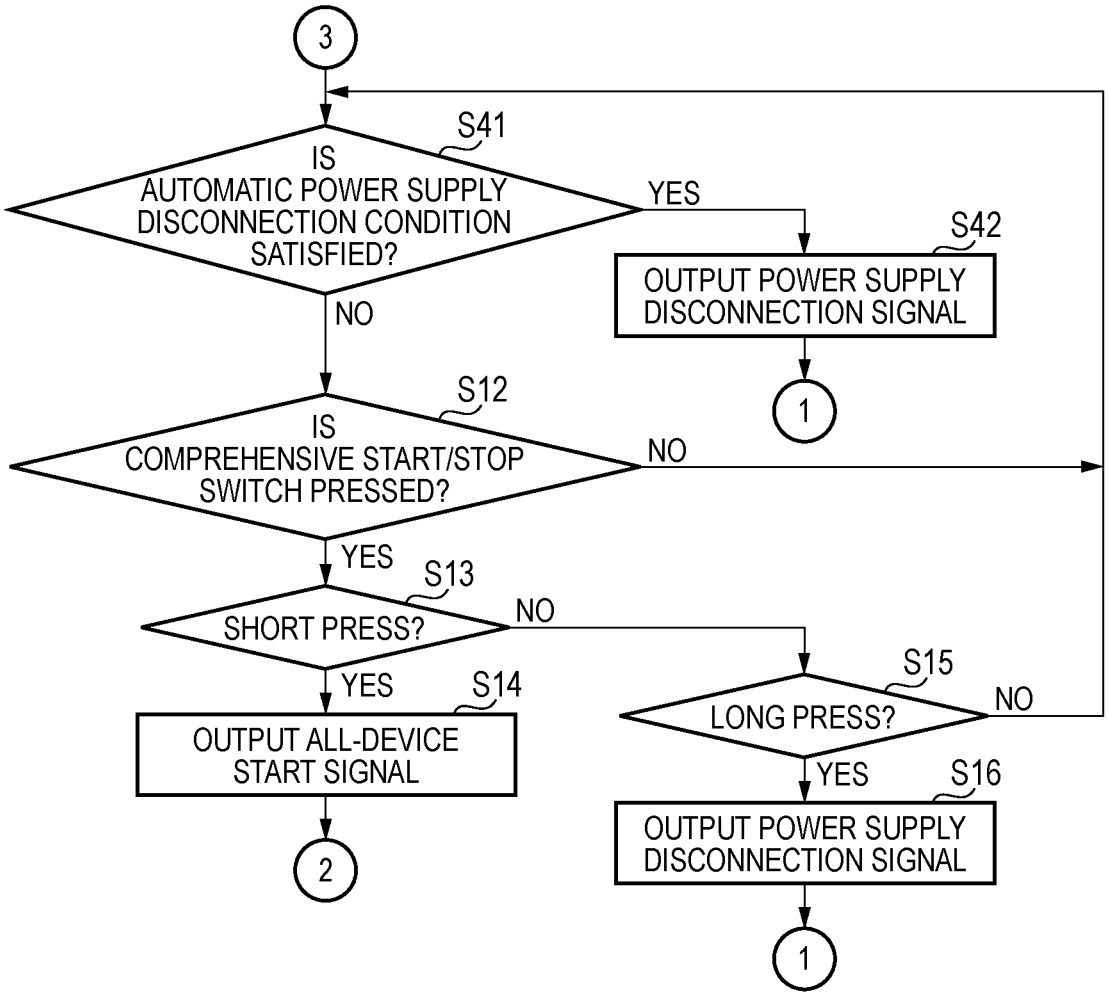
FIG. 7 is a flowchart showing a part of operation processing in an operation device according to a third embodiment of the present invention.

FIG. 7 shows a part of operation processing in the operation device 51 according to a third embodiment of the present invention. As can be seen from a comparison between FIG. 7 and FIG. 5, the third embodiment of the present invention is a modification of the processing in a state where each of the outboard motors 2, 3, the outboard motor control devices 12 to 18, and the ship-mounted equipment 30 to 35 is connected to the power supply 41, and the engine 5 of each of the outboard motors 2, 3 is stopped, in the operation processing of the first embodiment of the present invention. In FIG. 7, the same steps as those shown in FIG. 5 are denoted by the same reference numerals.

In the third embodiment of the present invention, as shown in FIG. 7, when an automatic power supply disconnection condition is satisfied while each of the outboard motors 2, 3, the outboard motor control devices 12 to 18, and the ship-mounted equipment 30 to 35 is connected to the power supply 41 and the engine 5 of each of the outboard motors 2, 3 is stopped (step S41: YES), the operation processing unit 53 of the operation device 51 outputs a power supply disconnection signal to the power supply connection unit 42 to disconnect each of the outboard motors 2, 3, the outboard motor control devices 12 to 18, and the ship-mounted equipment 30 to 35 from the power supply 41 (step S42). The automatic power supply disconnection condition is that a state continues for a predetermined time (for example, about 20 minutes to 30 minutes) in which the engines 5 of all the outboard motors 2, 3 attached to the ship are stopped, and the ship-mounted equipment 30 to 35 and the power supply 41 are connected. As a result, battery exhaustion can be prevented.

In each of the above embodiments, a case in which the two pressing modes of the comprehensive start/stop switch 52 are the short press and the long press is described as an example, but the pressing mode of the comprehensive start/stop switch 52 is not limited thereto. For example, the two pressing modes of the comprehensive start/stop switch 52 may be one press and two consecutive press. The two consecutive press is, for example, a mode in which the push button switch is pressed twice at short intervals of about 0.2 second to 0.5 second.

In each of the above embodiments, a case in which the operation processing unit 53 of the operation device 51 recognizes the positions of the operation levers 15A, 15B of the remote control device 15 (the positions of the gears of the outboard motors 2, 3) based on the lever position signal output from the remote control device 15 is described as an example, but the method of recognizing the positions of the gears of the outboard motors 2, 3 is not limited thereto. For example, other signals indicating the positions of the gears of the outboard motors 2, 3 may be used.

Further, in each of the above embodiments, a case where the two outboard motors 2, 3 are attached to the ship is described as an example, but the present invention can also be applied to a case where one outboard motor is attached to the ship or a case of three or more outboard motors are attached to the ship. The present invention can also be applied to a case where other types of ship propulsion machines such as an inboard/outboard motor and an inboard motor are used. The power source of the ship propulsion machine is not limited to the engine, and may be an electric motor.

As described above, in the second embodiment, the operation processing unit 53 performs the following operation processing. That is, when the user long-presses the comprehensive start/stop switch 52 while each of the outboard motors 2, 3, the outboard motor control devices 12 to 18, and the ship-mounted equipment 30 to 35 is disconnected from the power supply 41 and the engine 5 of each of the outboard motors 2, 3 is stopped, the operation processing unit 53 connects each of the outboard motors 2, 3, the outboard motor control devices 12 to 18, and the ship-mounted equipment 30 to 35 to the power supply 41 while maintaining the engine 5 of each of the outboard motors 2, 3 in a stopped state (see FIG. 3). Thereafter, when the user short-presses the comprehensive start/stop switch 52, the operation processing unit 53 starts the engines 5 of the outboard motors 2, 3 (see FIG. 5). Thereafter, when the user short-presses the comprehensive start/stop switch 52, the operation processing unit 53 stops the engines 5 of the outboard motors 2, 3 while maintaining the state where each of the outboard motors 2, 3, the outboard motor control devices 12 to 18, and the ship-mounted equipment 30 to 35 is connected to the power supply 41 (see FIG. 6). However, the operation processing may be changed as follows. That is, when the user long-presses the comprehensive start/stop switch 52 while each of the outboard motors 2, 3, the outboard motor control devices 12 to 18, and the ship-mounted equipment 30 to 35 is disconnected from the power supply 41 and the engine 5 of each of the outboard motors 2, 3 is stopped, the operation processing unit 53 connects the ship-mounted equipment 30 to 35 to the power supply 41 while maintaining a state where each of the outboard motors 2, 3 and the outboard motor control devices 12 to 18 is disconnected from the power supply 41 and the engine 5 of each of the outboard motors 2, 3 is stopped. Thereafter, when the user short-presses the comprehensive start/stop switch 52, the operation processing unit 53 connects each of the outboard motors 2, 3 and the outboard motor control devices 12 to 18 to the power supply 41, and starts the engines 5 of the outboard motors 2, 3. Thereafter, when the user short-presses the comprehensive start/stop switch 52, the operation processing unit 53 stops the engines 5 of the outboard motors 2, 3 and disconnects each of the outboard motors 2, 3 and the outboard motor control devices 12 to 18 from the power supply 41 while maintaining a state where the ship-mounted equipment 30 to 35 is connected to the power supply 41. Such a change in the operation processing can be realized by providing the ship propulsion system with a first power supply connection unit for switching between connection and disconnection between the ship-mounted equipment 30 to 35 and the power supply 41, and a second power supply connection unit for switching between connection and disconnection between the power supply 41 and each of the outboard motors 2, 3 and the outboard motor control devices 12 to 18, and performing connection/disconnection control on the two power supply connection units by the operation device.

Further, in each of the above embodiments, the multi-function gauge device 30, the radio 31, the wireless device 32, the lights 33, and the ship-dedicated display 34 are exemplified as the ship-mounted equipment in the ship propulsion system, but the ship-mounted equipment in the ship propulsion system may be any one of these devices, some of these devices, or electric equipment other than these devices provided in the ship. Further, it is not necessary to position all the electric equipment provided in the ship as the ship-mounted equipment in the ship propulsion system, and one or some of the plurality of electric equipment provided in the ship may be positioned as the ship-mounted equipment in the ship propulsion system. In other words, it is not necessary to connect all the electrical equipment provided in the ship to the power supply 41 via the power supply connection unit 42, and one or some of the plurality of electrical devices provided in the ship may be connected to the power supply 41 via the power supply connection unit 42.

The present invention can be modified as appropriate without departing from the scope or spirit of the invention which can be read from the claims and the entire description, and the operation device accompanying such a change is also included in the technical concept of the present invention.

What is claimed is:

1. An operation device in a ship propulsion system including a ship propulsion machine provided in a ship, ship-mounted equipment that is electric equipment provided in the ship, and a power supply provided in the ship propulsion machine or the ship, the operation device configured to perform an operation of connecting or disconnecting the ship-mounted equipment and the power supply and an operation of starting or stopping a power source of the ship propulsion machine, the operation device comprising:

a single push button switch; and an operation processor configured to perform processing in response to pressing of the push button switch, wherein the operation processor is configured:

to detect a pressing mode of the push button switch when the push button switch is pressed while the ship-mounted equipment and the power supply are disconnected and the power source is stopped, to perform processing of connecting the ship-mounted equipment and the power supply and starting the power source in a case where the detected pressing mode is a first mode, and to perform processing of connecting the ship-mounted equipment and the power supply while maintaining the power source in a stopped state in a case where the detected pressing mode is a second mode, and to perform processing of stopping the power source and disconnecting the ship-mounted equipment and the power supply when the push button switch is pressed while the ship-mounted equipment and the power supply are connected and the power source is in operation.

2. The operation device according to claim 1, wherein the operation processor is configured to detect a pressing mode of the push button switch when the push button switch is pressed while the ship-mounted equipment and the power supply are connected and the power source is stopped, to perform processing of starting the power source while maintaining a state where the ship-mounted equipment and the power supply are connected in a case where the detected pressing mode is the first mode, and perform processing of disconnecting the ship-mounted equipment and the power supply in a case where the detected pressing mode is the second mode.

3. The operation device according to claim 1, wherein the operation processor is configured to detect a pressing mode of the push button switch when the push button switch is pressed while the ship-mounted equipment and the power supply are connected and the power source is in operation, to perform processing of stopping the power source while maintaining a state where the ship-mounted equipment and the power supply are connected in a case where the detected pressing mode is the first mode, and to perform processing of stopping the power source and disconnecting the ship-mounted equipment and the power supply in a case where the detected pressing mode is the second mode.

4. The operation device according to claim 1, wherein the ship propulsion machine includes a propeller and a power transmission switching device configured to switch a position of a gear that transmits power of the power source to the propeller between a connection position at which the power of the power source is transmitted to the propeller and a disconnection position at which the power of the power source is not transmitted to the propeller, and when performing the processing of stopping the power source, the operation processor is configured not to stop the power source when the position of the gear is the connection position.

5. The operation device according to claim 1, wherein the operation processor is configured to disconnect the ship-mounted equipment and the power supply when a state where the power source is stopped and the ship-mounted equipment and the power supply are connected continues for a predetermined time.

6. The operation device according to claim 1, wherein the operation processor is configured to detect a duration of a state where the push button switch is pressed as the pressing mode of the push button switch, the first mode is a mode in which the duration of the state in which the push button switch is pressed is less than a first reference time, and the second mode is a mode in which the duration of the state in which the push button switch is pressed is equal to or longer than a second reference time longer than the first reference time.

7. The operation device according to claim 6, wherein the second reference time is equal to a preset duration of output of an alarm sound in operation confirmation processing of an alarm device provided in the ship.

8. The operation device according to claim 1, wherein the operation processer is configured to start power sources of a plurality of the ship propulsion machines provided in the ship at the same time when performing the processing of starting the power source.

* * * * *